US010207162B2

(12) United States Patent
Deshmukh

(10) Patent No.: US 10,207,162 B2
(45) Date of Patent: Feb. 19, 2019

(54) CO-FORGED GOLF CLUB HEAD AND METHOD OF MANUFACTURE

(71) Applicant: Acushnet Company, Fairhaven, MA (US)

(72) Inventor: Uday V. Deshmukh, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 120 days.

(21) Appl. No.: 14/963,070

(22) Filed: Dec. 8, 2015

(65) Prior Publication Data

US 2016/0089581 A1 Mar. 31, 2016

Related U.S. Application Data

(60) Continuation-in-part of application No. 14/589,079, filed on Jan. 5, 2015, which is a division of application No. 13/305,087, filed on Nov. 28, 2011, now Pat. No. 8,926,451.

(51) Int. Cl.
*A63B 53/04* (2015.01)
*B21K 17/00* (2006.01)

(52) U.S. Cl.
CPC ..... *A63B 53/047* (2013.01); *A63B 53/0466* (2013.01); *A63B 53/0475* (2013.01); *B21K 17/00* (2013.01); *A63B 2053/042* (2013.01); *A63B 2053/0416* (2013.01); *A63B 2053/0425* (2013.01); *A63B 2053/0433* (2013.01); *A63B 2053/0491* (2013.01); *A63B 2209/00* (2013.01)

(58) Field of Classification Search
USPC ..... 473/324–350
See application file for complete search history.

(56) References Cited

U.S. PATENT DOCUMENTS 1,453,503 A * 5/1923 Holmes ..... A63B 53/08 473/336
2,998,254 A * 8/1961 Rains ..... A63B 53/0487 473/336
3,825,991 A * 7/1974 Cornell ..... A63B 53/04 228/164
3,845,960 A * 11/1974 Thompson ..... A63B 53/04 473/336
3,979,122 A * 9/1976 Belmont ..... A63B 53/047 473/336
3,995,865 A * 12/1976 Cochran ..... A63B 53/04 473/337

(Continued)

FOREIGN PATENT DOCUMENTS

GB 2451317 A * 1/2009 ..... A63B 53/047
JP 06304273 A * 11/1994 ..... A63B 53/0466

(Continued)

*Primary Examiner* — Alvin Hunter

(57) ABSTRACT

A forged golf club face has a continuous outer layer of a first material encasing at least one inner layer made of second material. The materials may have differing properties, such as Young's Modulus, density, and strength properties, among others. By incorporating the different materials into the outer layer and the inner layer, the coefficient of restitution (COR) of the golf club face is improved without sacrificing durability. The club face is forged from a preformed billet having at least one monolithically encased inner layer.

20 Claims, 12 Drawing Sheets

(56) References Cited

U.S. PATENT DOCUMENTS 4,206,924 A * 6/1980 Koralik ..... A63B 53/04 473/349
4,607,846 A * 8/1986 Perkins ..... A63B 53/047 473/312
4,650,191 A * 3/1987 Mills ..... A63B 69/3632 473/341
4,824,115 A * 4/1989 Walther ..... A63B 53/0487 473/341
4,852,880 A * 8/1989 Kobayashi ..... A63B 53/04 473/349
5,013,041 A * 5/1991 Sun ..... A63B 53/04 473/252
5,221,087 A * 6/1993 Fenton ..... A63B 53/04 473/342
5,282,624 A * 2/1994 Viste ..... A63B 53/04 473/342
5,328,175 A * 7/1994 Yamada ..... A63B 53/04 473/345
5,348,302 A * 9/1994 Sasamoto ..... A63B 53/04 273/DIG. 23
5,407,202 A * 4/1995 Igarashi ..... A63B 53/04 473/342
5,584,770 A * 12/1996 Jensen ..... A63B 53/04 473/334
5,669,827 A 9/1997 Nagamoto
5,720,673 A * 2/1998 Anderson ..... A63B 53/04 473/324
5,735,755 A * 4/1998 Kobayashi ..... A63B 53/04 473/331
5,876,293 A * 3/1999 Musty ..... A63B 53/0487 473/341
5,964,669 A * 10/1999 Bloomer ..... A63B 53/0487 273/DIG. 14
5,993,331 A 11/1999 Shieh
6,015,354 A * 1/2000 Ahn ..... A63B 53/04 473/256
6,083,118 A * 7/2000 Martins ..... A63B 53/04 473/334
6,200,228 B1 * 3/2001 Takeda ..... A63B 53/04 473/324
6,299,548 B1 * 10/2001 Lin ..... A63B 53/04 473/331
6,302,804 B1 * 10/2001 Budde ..... A63B 53/0487 273/DIG. 8
6,450,894 B1 * 9/2002 Sun ..... A63B 53/0487 473/252
6,508,722 B1 * 1/2003 McCabe ..... A63B 53/04 473/330
6,921,343 B2 * 7/2005 Solheim ..... A63B 53/04 473/329
6,923,734 B2 * 8/2005 Meyer ..... A63B 53/047 473/336
7,018,303 B2 * 3/2006 Yamamoto ..... A63B 53/04 473/329
7,040,000 B2 * 5/2006 Takeda ..... A63B 53/04 29/505
7,169,062 B2 * 1/2007 Chen ..... A63B 53/0466 473/329
7,303,485 B2 * 12/2007 Tseng ..... A63B 53/04 473/332
7,338,388 B2 * 3/2008 Schweigert ..... A63B 53/0466 473/342
7,361,099 B2 4/2008 Rice et al.
7,380,325 B2 * 6/2008 Takeda ..... A63B 53/04 29/505
7,448,961 B2 * 11/2008 Lin ..... A63B 53/04 473/332
7,559,854 B2 * 7/2009 Harvell ..... A63B 53/0466 473/334
7,794,335 B2 * 9/2010 Cole ..... A63B 53/04 473/342
7,914,394 B2 * 3/2011 Cole ..... A63B 53/047 473/332
8,376,878 B2 * 2/2013 Bennett ..... A63B 53/0475 473/334
8,409,032 B2 4/2013 Myrhum et al.
8,434,671 B1 * 5/2013 Su ..... A63B 53/04 228/227
8,535,177 B1 * 9/2013 Wahl ..... A63B 69/3635 473/290
8,540,589 B2 * 9/2013 Bezilla ..... A63B 53/04 473/335
8,632,419 B2 * 1/2014 Tang ..... A63B 53/04 473/329
8,894,508 B2 11/2014 Myrhum et al.
8,926,451 B2 * 1/2015 Deshmukh ..... B21K 17/00 473/349
8,936,518 B2 * 1/2015 Takechi ..... A63B 53/047 473/335
9,387,370 B2 * 7/2016 Hebreo ..... B21K 17/00
2002/0061788 A1 * 5/2002 Marcase ..... A63B 53/04 473/324
2003/0181257 A1 * 9/2003 Yamamoto ..... A63B 53/04 473/342
2014/0073450 A1 3/2014 Hebreo et al.
2014/0148271 A1 5/2014 Myrhum et al.

FOREIGN PATENT DOCUMENTS

JP 08308964 A * 11/1996
JP 08308965 A * 11/1996
JP H11-70191 3/1999
JP 11089980 A * 4/1999
JP 11347159 A * 12/1999
JP 4351772 4/2001
JP 2003-169870 6/2003
JP 2004130125 A * 4/2004 ..... A63B 53/0487
JP 2004329335 A 11/2004
JP 2004350949 A * 12/2004
JP 2005143761 A * 6/2005 ..... A63B 53/04
JP 2006-167033 6/2006
JP 2011194266 A * 10/2011
JP 2012010768 A * 1/2012
JP 2012040311 A * 3/2012
JP 2013202186 A * 10/2013
WO WO 9920358 A1 * 4/1999 ..... A63B 53/04

* cited by examiner

CO-FORGED GOLF CLUB HEAD AND METHOD OF MANUFACTURE

PRIORITY CLAIM

The present application is a Continuation-In-Part of U.S. patent application Ser. No. 14/589,079, filed on Jan. 5, 2015, which is a divisional of U.S. patent application Ser. No. 13/305,087, filed on Nov. 28, 2011, now U.S. Pat. No. 8,926,451, the disclosures of which are incorporated by reference in their entireties. To the extent appropriate, a claim of priority is made to each of the above-referenced applications.

FIELD OF THE INVENTION

The present invention relates generally to a co-forged golf club head formed from two or more materials and the method of manufacture for such a golf club head. More specifically, the present invention relates to the creation of an iron type golf club head from a pre-form billet that already contains two or more materials before the actual forging process; resulting in a multi-material golf club head that doesn't require any post manufacturing operations such as machining, welding, swaging, gluing, and the like.

BACKGROUND OF THE INVENTION

Golf is hard! When your average golfer swings a golf club, he or she may have dramatic variations in his or her golf swing, resulting in numerous off-center hits, which result in diminished performance when compared to a direct center hit. However, in an attempt to make this very difficult game more enjoyable for the average golfer, golf club designers have come up with unique golf club designs that will mitigate the harsh realities of a less than perfect golf swing.

In one early example, U.S. Pat. No. 4,523,759 to Igarashi discloses a perimeter weighted hollow golfing iron having a foam core with an effective hitting area concentrated toward the center of moment in an attempt to help make the game of golf easier. Distributing the weight of a golf club to the perimeter allow the moment of inertia (MOI) of a golf club head to be increased, reducing the undesirable twisting a golf club as it impacts a golf ball.

U.S. Pat. No. 4,809,977 to Doran et al. shows another example of an attempt to increase the moment of inertia of a golf club head by placing additional weights at the heel and toe portion of the golf club head. This increase in the moment of inertia of the golf club head achievable by increased heel and toe weighting could further prevent the golf club from twisting in a heel and toe direction, which mitigates the undesirable effect of sending a golf ball off the intended trajectory.

Although the initial attempts at increasing the forgiveness and playability of a golf club for an average golfer are admirable, it does not take advantage of the extreme forgiveness that can be achievable by utilizing different materials to form different portions of the golf club head. In one example, U.S. Pat. No. 5,885,170 to Takeda shows the advantage of using multi-materials to create more extreme adjustment of the mass properties. More specifically, U.S. Pat. No. 5,885,170 teaches a body having a face formed of one material while a hosel is formed from another material having different specific gravity from that of the head body. U.S. Pat. No. 6,434,811 to Helmstetter et al. shows another example of utilization of multiple materials to improve the performance of a golf club head by providing a golf club head with a weighting system that is incorporated after the entirety of the golf club head has been formed.

More recently, the improvements in incorporating multi-materials into a golf club head have matured significantly by incorporating numerous multiple materials of different characteristics by machining cavities into the golf club head. More specifically, U.S. Pat. No. 7,938,739 to Cole et al. discloses a golf club head with a cavity integral with the golf club head, wherein the cavity extends from the heel region to the toe region; extending along a lower portion of the back face of the golf club head; extends approximately parallel to the strike face; and is approximately symmetrical about a centerline that bisects the golf club head between the heel region and the toe region.

However, as multiple materials are introduced into the golf club after the body has been completed, the tolerances of the interfaces between the different materials could potentially cause undesirable side effects of altering the feel of the golf club head. U.S. Pat. No. 6,095,931 to Hettinger et al. identifies this specific undesirable side effect of sacrifice in the feel by the usage of multiple different components. U.S. Pat. No. 6,095,931 addresses this issue by providing an isolation layer between the golf club head and the main body portion that comprises the striking front section.

U.S. Pat. No. 7,828,674 to Kubota recognizes the severity of this problem by stating that hollow golf club heads having viscoelastic element feels light and hollow to the better golfer, hence they do not prefer such a golf club. U.S. Pat. No. 7,828,674 address the deficiencies of such a multi-material golf club by incorporating a block of magnesium to be embedded and or press-fitted into the recess formed in the metal only to be sealed with a metallic cover.

Despite all of the above attempts to improve the performance of a golf club head all while trying to minimize the sacrifice in feel of a golf club, all of the methodologies require a significant amount of post manufacturing operation that creates cavities and recesses in the club head for the secondary material to be incorporated. These types of secondary operations are not only expensive, but the ability to maintain tight enough tolerances and bonds between the various components makes it very difficult to maintain the solid feel generally associated with an unitarily formed golf club head.

Hence, it can be seen from above, despite all of the development in creating a golf club head that's more forgiving without sacrificing the feel associated with a conventional club head, the current art is incapable of creating such a club without utilizing severe post manufacturing machining that causes bad feel.

BRIEF SUMMARY OF THE INVENTION

In one aspect of the present invention, a forged golf club head comprising a body portion having a striking surface made out of a first material, and at least one weight adjustment portion made out of a second material encased within the body portion; wherein the at least one weight adjustment portion is encased monolithically within the body portion of the golf club head without any secondary attachment operations.

In another aspect of the present invention, a method of forging a golf club head comprising the steps of creating a cylindrical billet out of a first material, machining one or more cavities within the cylindrical billet, partially filling the one or more cavities with a second material to create a weight adjustment portion, filling the remaining volume of the one or more cavities with the first material to encase the weight adjustment portion, and forging the cylindrical billet to create a body portion of the golf club head; wherein the body portion monolithically encases the weight adjustment portion within a body of the golf club head without any secondary attachment operations.

In another aspect of the present invention is a forged golf club head comprising a body portion having a striking surface made out of first material, and at least one weight adjustment portion made out of a second material encased within the body portion; wherein the at least one weight adjustment portion is encased monolithically within the body portion without any secondary attachment operations. The first material has a first flow stress at a first forging temperature and the second material has a second flow stress at a second forging temperature, wherein the first flow stress and the second flow stress are substantially similar to one another, and the first forging temperature and the second forging temperature are substantially similar to one another. The first material has a first thermal expansion coefficient and the second material has a second thermal expansion coefficient, wherein the first thermal expansion coefficient is greater than or equal to the second thermal expansion coefficient.

These and other features, aspects and advantages of the present invention will become better understood with references to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
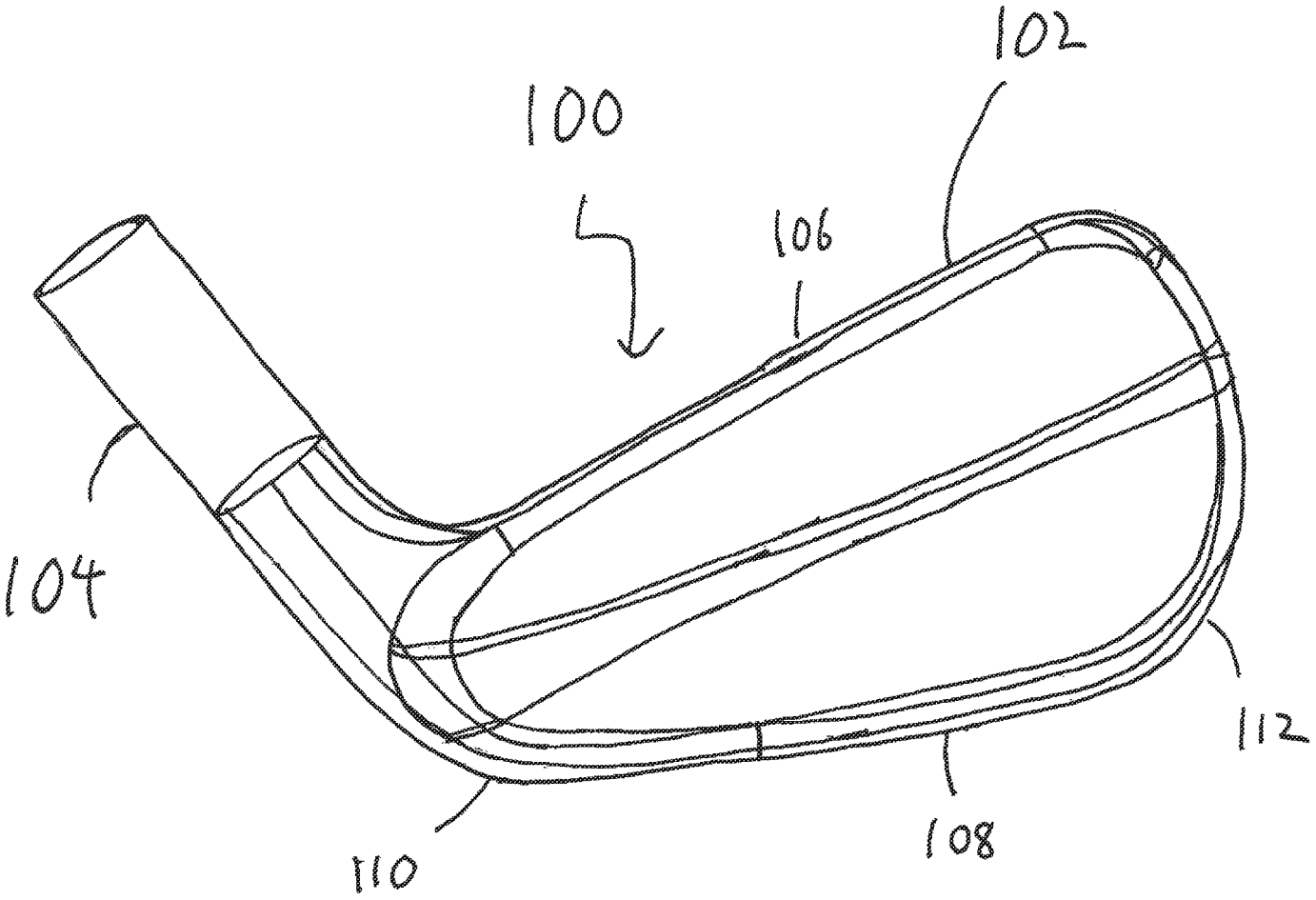
FIG. 1 of the accompanying drawings shows a perspective view of a co-forged golf club head in accordance with an exemplary embodiment of the present invention.

FIG. 1 of the accompanying drawings shows a perspective view of a golf club head 100 in accordance with an exemplary embodiment of the present invention. The golf club head 100 shown in FIG. 1 may generally comprise of a body portion 102 and a hosel portion 104, with the body portion 102 having several individually identifiable components such as a topline portion 106, a sole portion 108, a heel portion 110, and a toe portion 112. The golf club head 100 in accordance with an exemplary embodiment of the present invention may generally be comprised of at least one weight adjustment portion that is encased within the body portion 102 of the golf club head 100. In a preferred embodiment, the weight adjustment portion may be monolithically encased within the body portion 102 to ensure that the weight adjustment portion is secured within the body portion 102 without departing from the scope and content of the present invention. Because the weight adjustment portion is monolithically encased within the body portion 102 of the golf club head 100, these weights are not visible in FIG. 1 of the accompanying drawings. However, these weight adjustment portions will be shown in more detail in later figures, when various different views are presented.

Before moving onto subsequent figures, it is worthwhile here to emphasize that the current golf club head 100 is created using a forging process and the weights are incorporated without any post finish machining operations. This is an important distinction to establish because the same result of a monolithically encasing a weight adjustment portion is extremely difficult to achieve using alternative manufacturing processes such as casting. "Monolithically encased", as referred to in the current patent application, may generally be defined as a having a specific internal component placed inside a separate external component without joints or seams in the finished product. With respect to the current invention, having weight adjustment portions "monolithically encased" within the body portion 102 of the golf club head 100 may generally refer to the ability to have weight adjustment portions placed inside the body portion 102 of the golf club head without joints or seams that are generally required by post manufacturing processes such as milling, welding, brazing, gluing, or swaging. In examples, the encasement technology herein results in a single material exterior of a clubface, which also allows for more uniform surface conditioning processes, such as chrome plating. For instance, chrome plating a single material is more feasible than attempting to chrome plate two different materials. While individual materials can be chrome plated, the different materials are generally required to be plated in separate operations. Other surface conditioning processes, such as physical vapor deposition (PVD) coating and texturing, also benefit from having a uniform exterior of a club face.

It should also be noted here that a weight that is "monolithically encased" within the current definition of the present invention could potentially have certain aspect of the internal weights exposed in the finish product to illustrate the existence of a weight adjustment portion without departing from the scope and content of the present invention. More specifically, "monolithically encased" refers to the methodology used to create the ultimate product as described above, and may not necessarily be limited to visually concealing the weight adjustment member.

FIGS. 2A-2D illustrate the methodology used to create a co-forged golf club head 200 in accordance with an exemplary embodiment of the current invention. More specifically, FIGS. 2A-2D illustrate the steps involved in the forging of a golf club head from its rudimentary billet 201 shape into the final product of a golf club head 200.

Figure 2D:
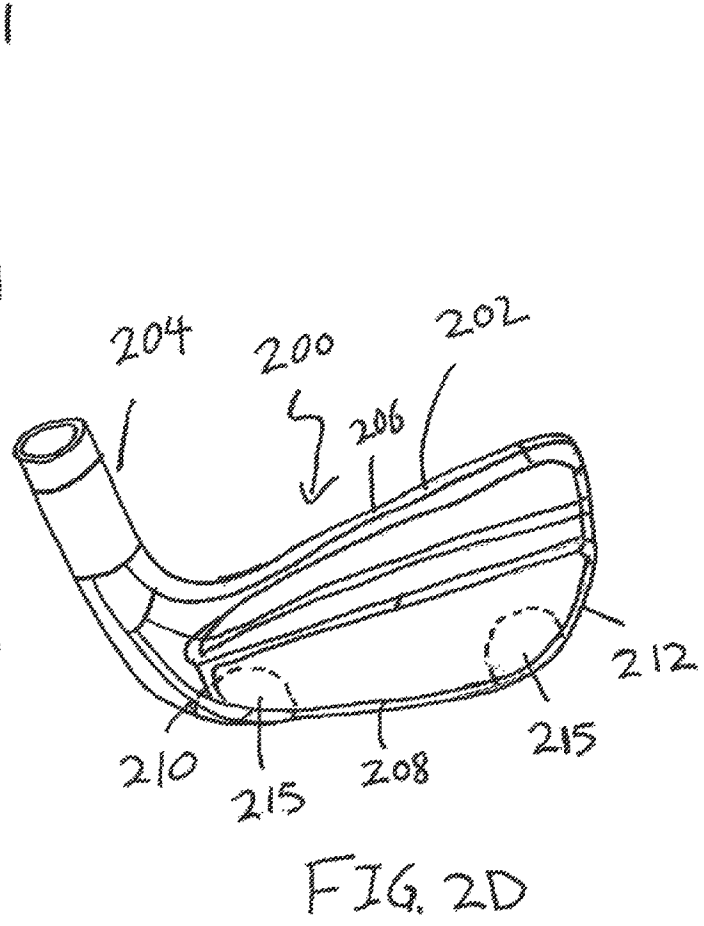
FIGS. 2A-2C show perspective views of pre-formed billets used to create a golf club head, shown in FIG. 2D, in accordance with an exemplary embodiment of the present invention.
Figure 2A:
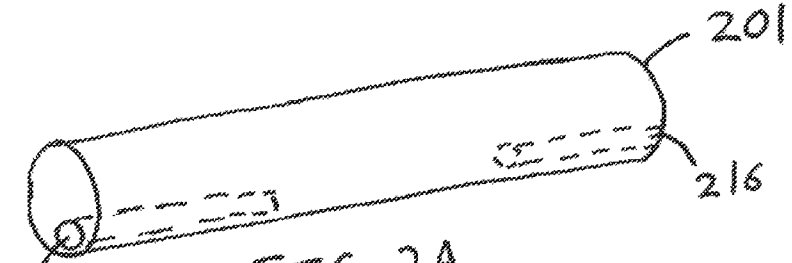

FIG. 2A shows a pre-formed billet 201 in accordance with an exemplary embodiment of the present invention. As it can be seen from FIG. 2A, the pre-form billet 201 may generally begin as a cylindrical rod formed from a first material, as it is common with the forging of a golf club head 200. In order to create a weight adjustment portion 215 that can be monolithically encased within the body portion 202 of the golf club head 200, one or more cavities 216 are machined into the pre-form billet 201. In this current exemplary embodiment shown in FIG. 2A, two cavities 216 are machined into the terminal ends of the pre-form billet 201. The location and geometry of the cavities 216 within the pre-form billet 201 are important, as it correlates directly with the ultimate location of the weight adjustment portion 215 in the golf club head 200 after forging.

Figure 2B:
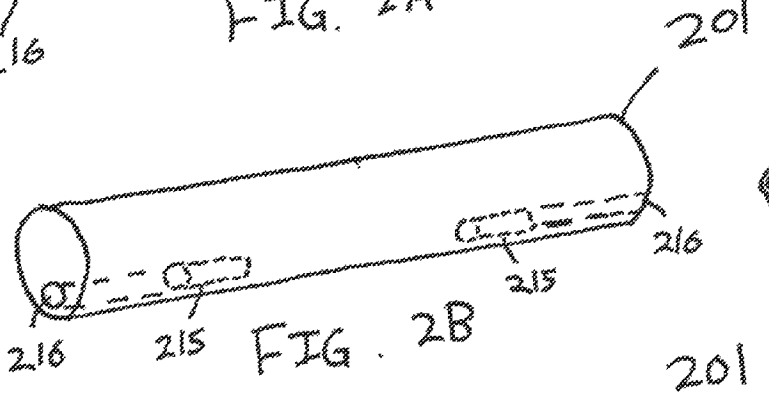

Moving onto FIG. 2B, it can be seen that once the cavities 216 are machined, the cavities 216 are partially filled with a second material that has a density different from the density of the first material in order to create the weight adjustment portion 215. Similar to the discussion above, the location, size, and shape of the weight adjustment portion 215 is just as critical as the location, size, and shape of the cavities 216, as the weight adjustment portion 215 within the pre-form billet 201 correlates with the ultimate resting place of the weight adjustment portion 215 in the golf club head.

Figure 2C:
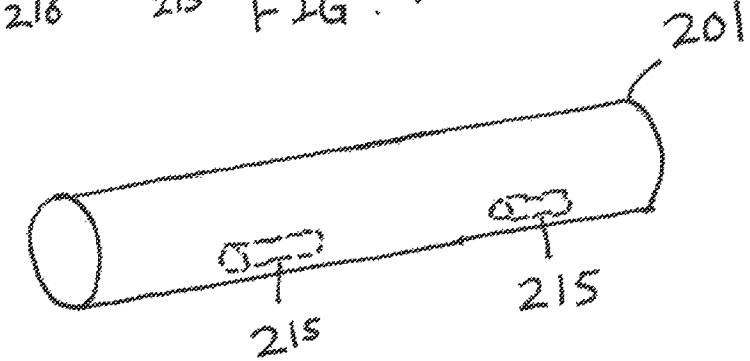

Finally, FIG. 2C shows the final phase of the pre-form billet 201 as the remaining volume of the cavities 216 are filled with the first material and sealed through traditional joining methods such as welding, brazing, and swaging. Sealing the cavities 216 allows the weight adjustment portion 215 to be monolithically encased within the body of the pre-form billet 201, which will allow the same weight adjustment portion 215 to be monolithically encased in the body 202 of the golf club head 200 after the forging process. After the cavities 216 are filled, the pre-form billet 201 is subjected to the normal forging process associated with the forging of a golf club head 200. Although the basic steps involved in forging a golf club head 200 are important to the understanding of the current invention, it involves a relatively archaic and established technique, which the present application will not dive into much detail. More information regarding the steps involved in the forging of a basic golf club head without monolithically encased weight adjustment portions can be found in U.S. Pat. No. 3,825,991 to Cornell, and U.S. Pat. No. 6,666,779 to Iwata et al., the disclosure of which are all incorporated by reference in its entirety.

Although the above discussion regarding the forging of golf clubs incorporated by reference do a good job describing the actual forging process, it fails to address the additional concerns with the co-forging process of the current invention wherein two different materials are involved in this forging process. More specifically, because a weight adjustment portion 215 is made out of a second material that could be different from the first material used to create remainder of the pre-form billet 201, special care must be taken to ensure that the different materials can be forged together to form a golf club head 200. Hence, in order to select two cohesive materials that are capable of being co-forged together, the first material and the second material may generally have to have very specific material properties requirements with respect to their flow stress and their thermal expansion coefficient. Although it is most preferential for the two materials to have identical material properties yielding consistency in forging, the usage of identical materials may not offer any weight adjustment benefits required for the basis of the current invention.

First off, in order for metallic materials to have the capabilities of being co-forged together, the respective flow stress of each of the materials needs to be properly considered. Flow stress of a material, may generally be defined as the instantaneous value of stress require for continued deforming of the material (i.e. to keep the metal flowing); and the creation of a cohesive forged component from two different materials will require them to flow at relatively the same speed when subjected to the stresses of the forging process. It is commonly known that the flow stress of a material is generally a function of the yield strength, the flow stress of a material may generally be summed up by Eq. (1) below.

$$Y_f = Ke^n \qquad \text{Eq. (1)}$$

wherein $Y_f$=Flow Stress (MPa)

K=Strain Coefficient (MPa)

n=Strain Hardening Exponent

In addition to the above equation, it is worthwhile to mention here that the flow stress of a material may not be construed in vacuum, but rather, it is a function of the forging temperature of the material as well. Hence, in a current exemplary embodiment of the present invention, a first flow stress of the first material at its first forging temperature is substantially similar but not identical to the second flow stress of the second material at its second forging temperature; with the first forging temperature and the second forging temperature being substantially similar. More specifically, in a more detailed embodiment, the first material may be 1025 steel having a first flow stress of about 10 ksi (kilo-pound per square inch) at a forging temperature of about 1,200° C., while the second material may comprise a Niobium material having a second flow stress of also about 12 ksi at a forging temperature of about 1,100° C.

Although in the exemplary embodiment of the present invention described above, the first material may be a 1025 steel and the second material may be a Niobium material, various other materials may also be used without departing from the scope and content of the present invention so long as their flow stresses are similar at a similar forging temperature. Alternatively speaking, any two materials may be used in the current co-forging process so long as the second flow stress is no more than 20% greater or no less than 20% lesser than the first flow stress.

As mentioned before, other than flow stress, the thermal expansion coefficient of the first and second materials are also important to the proper co-forging of two distinct materials. More specifically, a first thermal expansion coefficient of the first material may generally need to be greater than or at least equal to the second thermal expansion coefficient of the second material. Because the thermal expansion coefficient also relates to the shrinkage of the material after forging, it is important that the first material that monolithically encases the second material have a higher thermal expansion coefficient to prevent gaps from forming at the interface portion of the materials. In a more detailed embodiment of the present invention, the first material may be 1025 steel having a thermal expansion coefficient of about 8.0 μin/in° F., while the second material may be Niobium having a second thermal expansion coefficient of about 3.94 μin/in° F.

It should be noted that although in the above exemplary embodiment the second thermal expansion coefficient is smaller than the first thermal expansion coefficient, the numbers can be identical to achieve perfect mating of the two materials without departing from the scope and content of the present invention. In fact, in one exemplary embodiment of the present invention, it may be preferred for the first material and the second material to have the same thermal expansion coefficient, as excessive shrinkage of the outer material upon the inner material could potentially create additional stresses at the interface portions of the two materials.

Alternatively, in an attempt to provide different weighting characteristics, the second material could be made out of a 6-4 Titanium material to reduce the weight of the weight adjustment portion 215. The Titanium material may generally have a flow stress of about 10 ksi at a forging temperature of about 1,100° C. and a thermal expansion coefficient of about 6.1 μin/in° F.

Now that the forging process, and the specific concerns involving the co-forging of different materials have been discussed, FIG. 2D of the accompanying drawings shows a perspective view of a finished golf club head 200 created using the co-forging process above, wherein the golf club head 200 monolithically encases at least one weight adjustment portion 215 within the body portion 202. More specifically, in the current exemplary embodiment of the present invention, the weight adjustment portions 215 are placed near a heel portion 210 and a toe portion 212 of the golf club head 200. The placement of the weight adjustment portion 215 near a heel portion 210 and the toe portion 212 allow the golf club head 200 to have an increase in the Moment of Inertia (MOI) without the need for any secondary attachment operations; which will result in a more consistent feel upon impact with a golf ball.

Before moving onto a discussion regarding different embodiments of the present invention, it is worthwhile here to note that the exact placement of the weight adjustment portion 215 within the body portion 202 of the golf club head 200 is slightly different in every single different club head, this is the outcome of the current inventive co-forging process involves different materials. More specifically, the exact placement of the weight adjustment portion 215 may differ with each single golf club 200, as the flow stress of the first material and the second material will help determine the final location of the weight adjustment portion 215. In addition to the above, it should be noted that the interface between the weight adjustment portion 215 and the body portion 202 of the golf club head 200 may generally be an irregular interface, with the boundaries jagged to indicate that the entire golf club head 200 has been co-forged. This is dramatically different from a cavity created via a post machining secondary operations such as milling and drilling; which generally have clean bifurcation lines of the two different materials.

FIGS. 3A-3D of the accompanying drawings shows an alternative embodiment of the present invention wherein two separate weight adjustment portions 314 and 315 are placed at different portions of the pre-form billet 301 to create a golf club head 300 with a different performance criteria. More specifically, the golf club head 300 shown in FIG. 3D may have a lightweight weight adjustment portion 314 near a topline portion 306 of the golf club head 300 and a heavyweight weight adjustment portion 315 near a sole 308 of the golf club head 300 to help shift the Center of Gravity (CG) of the golf club head 300 lower to help with launch and spin characteristics of the current inventive golf club head 300.

Figure 3D:
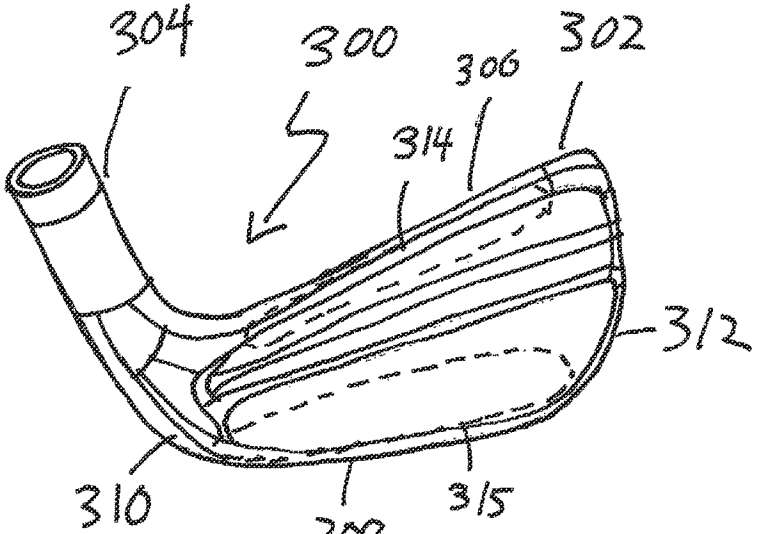
FIGS. 3A-3C show perspective views of pre-formed billets used to create a golf club head, shown in FIG. 3D, in accordance with an exemplary embodiment of the present invention.
Figure 3A:
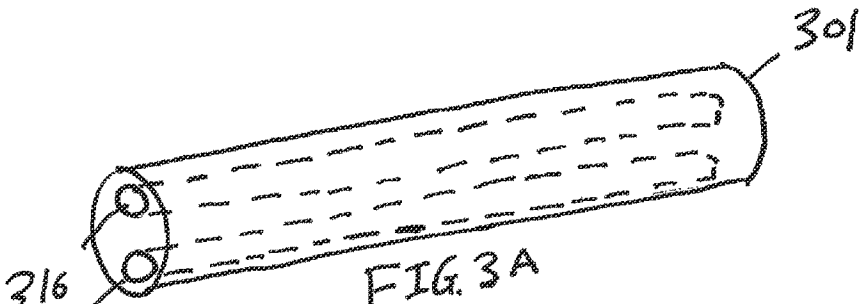
Figure 3B:
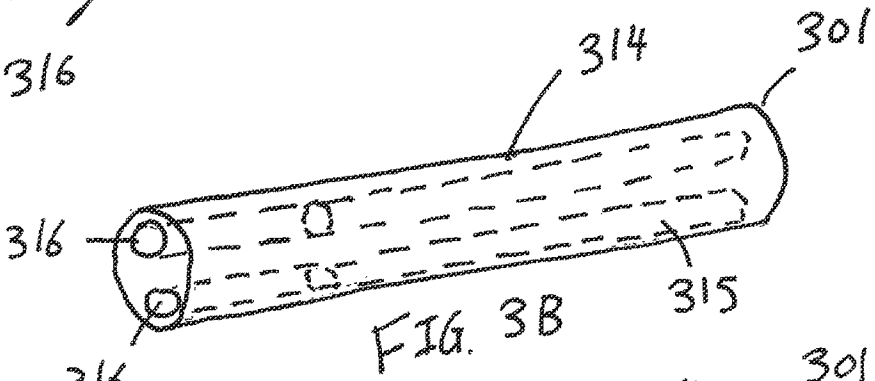
Figure 3C:
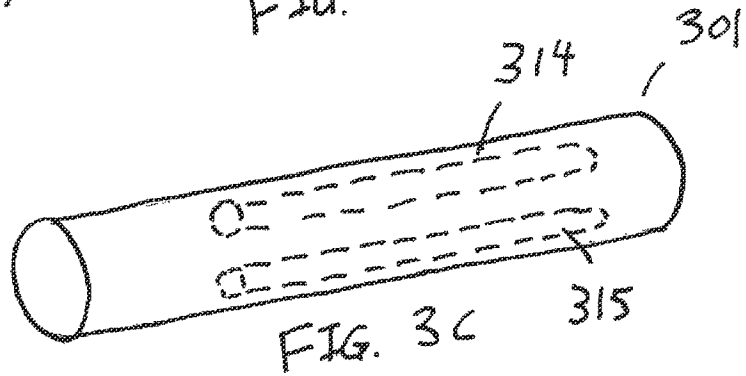
Figures 4A, 4B, 4C, 4D:
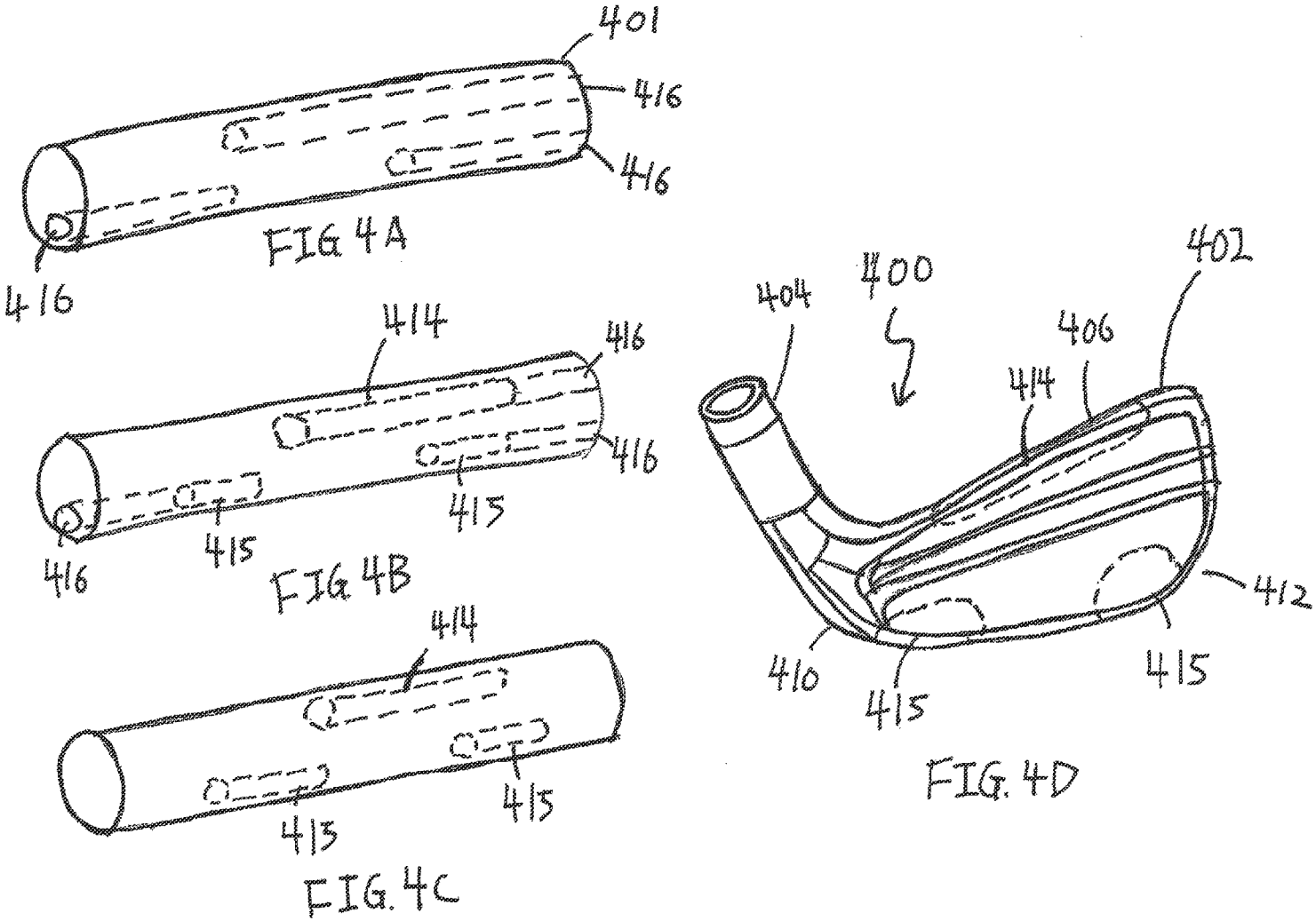
FIGS. 4A-4C show perspective views of pre-formed billets used to create a golf club head, shown in FIG. 4D, in accordance with an exemplary embodiment of the present invention.

FIG. 3A-3C, similar to before, show the formation process of the current inventive golf club head 300, starting from a pre-form billet 301. More specifically, FIG. 3A shows a perspective view of a pre-form billet 301 in accordance with an exemplary embodiment of the present invention wherein a plurality of cavities 316 are drilled at strategic locations within the billet 301. It should be noted that in this current exemplary embodiment the plurality of cavities 316 are drilled near a top portion and a bottom portion of the pre-form billet 301 instead of at each of the terminal ends, as this specific embodiment focuses on lowering the CG of the golf club head 300 by removing weight from the top line portion 306 of the golf club head 300 and shifting it towards a sole portion 308 of the golf club head 300.

FIG. 3B of the accompanying drawings shows two weight adjustment portions 314 and 315 being placed inside the cavities 316 created in FIG. 3A. Although it may generally be desirable to minimize the weight near a top portion of a golf club head 300 when one desires to lower the CG, top cavity 316 can not be left completely blank in this current embodiment of the present invention, as the entire pre-form billet 301 will eventually be forged into the shape of a golf club head 300, causing any empty cavity 316 to collapse upon itself. Hence, in this current exemplary embodiment of the present invention, the top cavity 316 may be filled with a lightweight weight adjustment portion 314, while the lower cavity 316 may be filled with a heavyweight weight adjustment portion 315. The lightweight weight adjustment portion 314 may generally be made out of a third material having a third density, wherein the heavyweight weight adjustment portion 315 may generally be made out of second material having a second density. In one exemplary embodiment of the present invention, the third density may generally be less than about 7.0 g/cc, wherein the second density may generally be greater than about 7.8 g/cc; while the first material used to form the body portion 302 of the golf club head 300 may generally have a first density of about 7.8 g/cc.

FIG. 3C of the accompanying drawings shows the final stage of the pre-form billet 301 that has monolithically encased the weight adjustment portions 314 and 315 within the internal cavities 316 of the pre-form billet 301. More specifically, the creation of the pre-form billet shown in FIG. 3C involves filling in the remaining volume of the cavities 316 with a first material to encase the weight adjustment portions 315 and 316 within the pre-form billet 301. Similar to the above discussion, the pre-form billet 301, is subsequently forged to create a golf club head 300 as shown in FIG. 3D, wherein the weight adjustment portions 314 and 315 are monolithically encased within the body portion 302 of the golf club head 300.

Similar to the methodology described above, the co-forging of the third material within the cavity created within the first material, the third material may generally need to have a third flow stress that is similar with the first flow stress of the first material and a third thermal expansion coefficient less than the first thermal expansion coefficient of the first material. More specifically, in one exemplary embodiment of the present invention, the third material may be a 6-4 Titanium material having a third flow stress of about 10 ksi at a forging temperature of about 1,100° C. and a third thermal expansion coefficient of about 6.1 μin/in° F.

Although FIGS. 2A-2D and FIGS. 3A-3D show different embodiments of the present invention used to achieve a higher MOI and a lower CG respectively, these features are not mutually exclusive from one another. In fact, in a further alternative embodiment of the present invention shown in FIGS. 4A-4D, features may be taken from both embodiments discussed above to create a co-forged golf club head with a higher MOI as well as a lower CG all without departing from the scope and content of the present invention. More specifically, in FIGS. 4A-4D, the steps needed to incorporate a lightweight weight adjustment portion 414 near a top portion 406 of a golf club 400 together with two or more heavyweight weight adjustment portions 415 near a toe portion 412 and a heel portion 410 of the golf club head 400 to create a golf club with higher MOI and a lower CG.

FIG. 5A-5D of the accompanying drawings shows a further alternative embodiment of the present invention wherein the body portion 502 of the golf club head 500 may be comprised of a monolithically encased weight adjustment portion 514. In this current exemplary embodiment of the present invention, the weight adjustment portion 514 may be relatively large in size, allowing it to replace a majority of the body portion 502 of the golf club head 500 once the forging process is completed. In this current exemplary embodiment of the present invention, the monolithically encased weight adjustment portion 514 may generally be made out of a third material having a third density that is significantly lower than the first density of the first material used to form the body portion 502 of the golf club head 500; allowing weight to be taken out from the body portion 502 of the golf club head 500. Because the lightweight third material used to form the weight adjustment portion 514 may generally be relatively soft compared to the first material, it is generally desirable to monolithically encase the weight adjustment portion 514 within the internal body of the golf club head 500, allowing significant weight savings to be achieved without sacrificing feel.

Figure 5D:
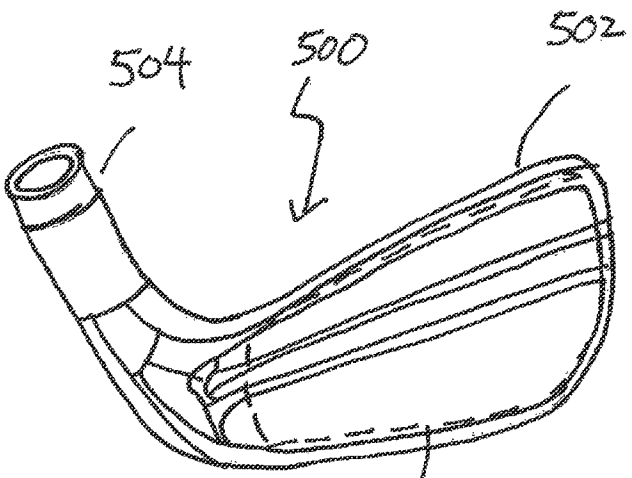
FIGS. 5A-5C show perspective views of pre-formed billets used to create a golf club head, shown in FIG. 5D, in accordance with an exemplary embodiment of the present invention.
Figure 5A:
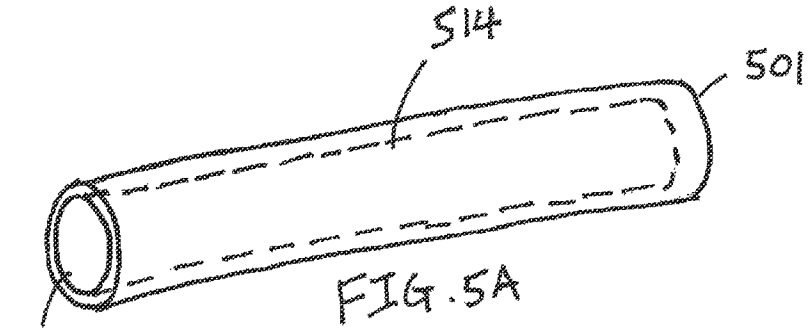
Figure 5B:
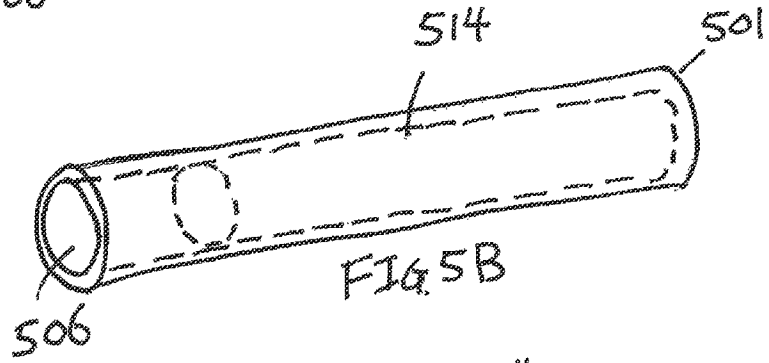
Figure 5C:
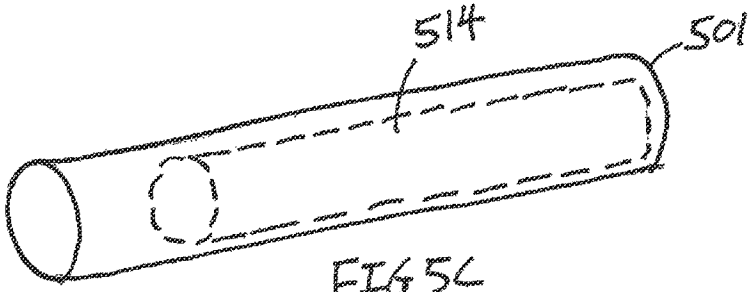

More specifically FIG. 5A of the accompanying drawings shows a pre-form billet 501 similar to the previous figures. However, in this current exemplary embodiment, the cavity 506 is significantly larger within the pre-form billet 501 itself. This large cavity 506 can then be used in FIG. 5B to be filled with a weight adjustment portion 514 to adjust the weight, density, and overall feel of the golf club head 500. In FIG. 5C, similar to described above, the remaining volume of the cavity 516 is filled with the original first material before the entire pre-form billet 501 is subjected to the forging process to create a golf club head 500.

It is worth noting here that in this current exemplary embodiment, the hosel portion 504 of the golf club head 500 is deliberately made from the conventional first material, as the bending characteristics of the second material used to form the weight adjustment portion 514 may generally not be suitable for the bending requirements of an iron type golf club head 500. More specifically, the third material used to form the weight adjustment portion 514 could be a lightweight iron-aluminum material having a density of less than about 7.10 g/cc, more preferably less than about 7.05 g/cc, and most preferably less than about 7.00 g/cc, all without departing from the scope and content of the present invention. However, numerous other materials can also be used as the third material used to form the weight adjustment portion 514 without departing from the scope and content of the present invention so long as the third material has a density within the range described above.

The materials in a pre-formed billet may also be selected to modify additional properties of a golf club head other than the weight and weight distribution thereof. For example, materials may be selected to adjust the coefficient of restitution (COR) of a golf club head or, more specifically, a striking face of a golf club head. A higher COR for a striking face is generally desired as a higher COR generally corresponds to a higher velocity of a golf ball when struck by the golf club. The COR of a golf club may be increased by increasing the compliance of the striking face portion of the golf club. One way to increase the compliance is to decrease the thickness of the striking face. Reducing the thickness of the striking face, however, often reduces the durability of the face. Due in part to that disadvantage, another way to increase the compliance of the striking face is provided herein. By selecting materials having lower values for their respective Young's Modulus in a pre-formed billet, the striking face may be forged to have a higher compliance and COR than a standard striking face made of a single material.

Figure 6A:
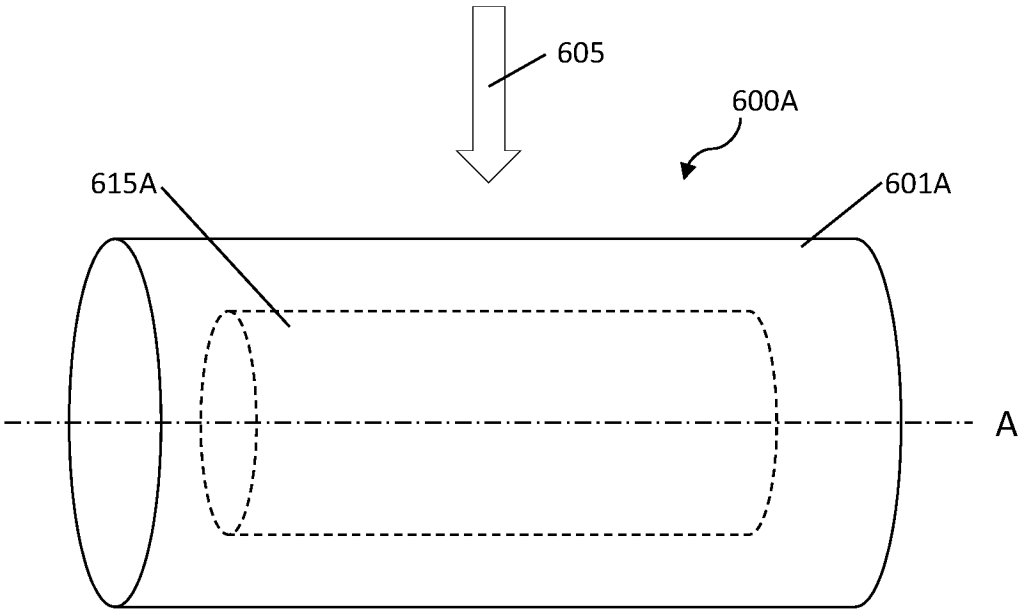
FIG. 6A shows a perspective view of a pre-formed billet used to create a golf club head in accordance with the present technology.

FIG. 6A shows a perspective view of a pre-formed billet 600A used to create a golf club head in accordance with the present technology. Pre-formed billet 600A includes a continuous outer layer 601A made of a first material and an inner layer 615A made of a second material. The inner layer 615A is fully encased by the continuous outer layer 601A, and the inner layer has a central axis A. The inner layer 615A may be monolithically encased within the continuous outer layer 601A, similar to the weight adjustment portions incorporated into the pre-formed billets described above. For example, similar to the incorporation of a weight adjustment portion, a cavity may be machined into the pre-formed billet 600A, and then the inner layer 615A is inserted into the cavity. The fit between the inner layer 615A and the continuous outer layer 601A may be achieved through a press fit, a threaded fit, or any other means that can be used to form a contact between the two layers while encapsulating the inner layer 615A within the continuous outer layer 601A. In an example, the continuous outer layer 601A is heated, causing expansion, while the inner layer 615A is inserted. Prior to insertion, the inner layer may also be coated with a material to facilitate bonding between the inner layer 615A and the continuous outer layer 601A. Once the inner layer 615A has been inserted in to the cavity, the remainder of the cavity is filled with the same material as the continuous outer layer 601A, which is then sealed using the means described above, such as welding, brazing, swaging, and the like.

To increase the compliance of a striking face forged from the pre-formed billet 600A, the materials of the continuous outer layer 601A and the inner layer 615A are selected to have different elastic properties, such as different values for their respective Young's Modulus. In an example, the inner layer 615A has a lower Young's Modulus than the continuous outer layer 601A. In examples, the continuous outer layer 601A material may have a Young's Modulus greater than about 130 GPa, 150 GPa, or 170 GPa. In examples, the inner layer 615A material may have a Young's Modulus below about 130 GPa, 115 GPA, 95 GPa, 90 GPa, or 80 GPa. For instance, the continuous outer layer 601A may be made from a steel and the inner layer 615A may be made from titanium, titanium alloys, beta titanium alloys, copper and copper alloys including brasses and bronzes, vanadium and vanadium alloys, zirconium and zirconium alloys, silicon and silicon alloys, hafnium and hafnium alloys, niobium and niobium alloys, scandium and scandium alloys, manganese and manganese alloys, yttrium and yttrium alloys, along with some rare earths and other similar materials having a lower Young's Modulus than the steel or other material forming the continuous outer layer 601A. These materials may also form one or more of other portions of a golf club head, such as a crown or sole of the golf club head. Other considerations for selecting the inner layer 615A material include the desirability for strength properties to accommodate the high stress associated with use. For instance, the inner layer 615A material may have a yield strength of greater than about 500 MPa, 600 MPa, 700 MPa, 750 MPa, 850 MPa, or 950 MPa, depending on the particular application. The inner layer 615A material may also be selected such that it bonds well with the continuous outer layer 601A material. The flow stresses and thermal expansion coefficients may also be considered in selecting materials, as discussed above. In a specific example, the continuous outer layer 601A may be made of a 17-4PH steel having a Young's Modulus of about 200 GPa and a beta titanium alloy Ti-15-3-3-3 having a Young's Modulus of about 80 GPa. In that example, the Young's Modulus of the striking face formed from the pre-formed billet 600A may be about 140 GPa if the continuous outer layer 601A and the inner layer 615A have approximately equal thicknesses. To further lower the Young's Modulus of the striking face, the amount of titanium alloy included in the pre-formed billet 600A may be increased.

The material for the continuous outer layer 601A may also be selected depending on how the forged striking face is to be attached to the remainder of the golf club head, such as a crown and a sole of golf club. For example, where the striking face is to be attached to the remainder of the golf club head via welding, the welding process forms a stronger bond when the two materials being joined are of the same class, e.g., a plain carbon steel with a plain carbon steel, a stainless steel with a stainless steel, a titanium alloy with a titanium alloy, and so forth. Accordingly, the material for the continuous outer layer 601A may be selected to be in the same class as the material of the club head to which the continuous outer layer 601A will be attached after forging.

In some examples, such as with drivers or fairway metals, the remainder of the club face to which the continuous outer layer 601A is to be attached is made of a titanium material. For instance, a crown and a sole of a driver, to which a striking face is to be welded, may be made of a titanium material. In such examples, the continuous outer layer 601A may also be made of a titanium material to facilitate a stronger weld. Further, the inner layer 615A incorporated into the striking face may then be made of a material having a higher Young's Modulus than the titanium material of the continuous outer layer.

In examples, the inner layer 615A is substantially centered within the continuous outer layer 601A. As such, during forging, the inner layer 615A may be substantially centered on the striking face. Once the pre-formed billet 600A is forged into a striking face of a golf club head, the inner layer 615A may be substantially centered between a top portion of the golf club head and a bottom portion of the golf club head, similar to the forged placement of the weight adjustment portion 514 in FIG. 5D. In other applications, the location of the inner layer 615A may be adjusted to achieve desired properties of the golf club head. Additionally, multiple inner layers 615A may be included within the pre-formed billet 600A, similar to the multiple weight adjustment portions depicted in FIGS. 2C, 3C, and 4C.

Figure 6B:
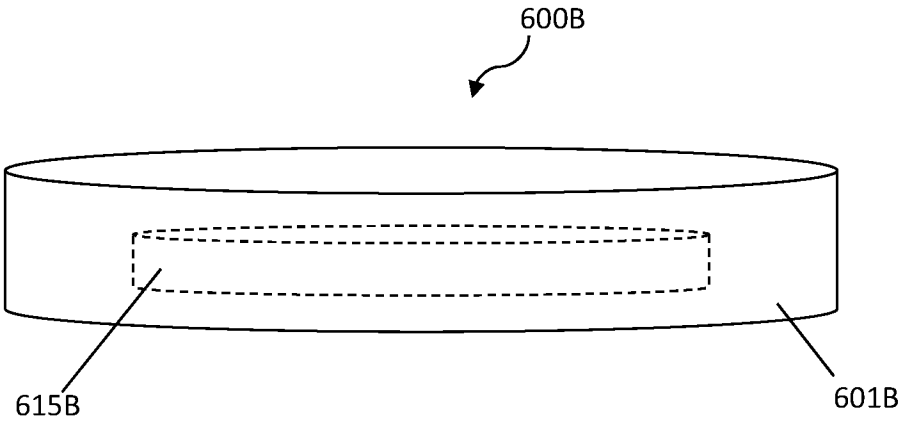
FIG. 6B shows a perspective view of a forged face used to create a golf club head in accordance with the present technology.

In some examples, the pre-formed billet 600A may be forged in forging direction 605, resulting in a forged face 600B having a forged continuous outer later 601B and a forged inner layer 615B, as shown in FIG. 6B. As discussed above, as the pre-formed billet 600A is heated to an appropriate material-dependent forging temperature, and it is then forged into the desired shape. While depicted schematically as a disk shape in FIG. 6B, the forged face 600B may be formed as part of striking face, such as by the forging processes described above. The forged face 600B may also be formed as a striking face of a fairway metal, a driver, or a hybrid club as well. For example, the forged face 600B may be formed as a face insert, a face cup, a partial cup, or an "L" or "C" shaped-face as the particular application or design may require. In some examples, the forged face 600B may be trimmed after forging to obtain the desired shape. Depending on the application, care should be taken during the forging and trimming process to avoid exposing the forged inner layer 615B.

Figure 7A:
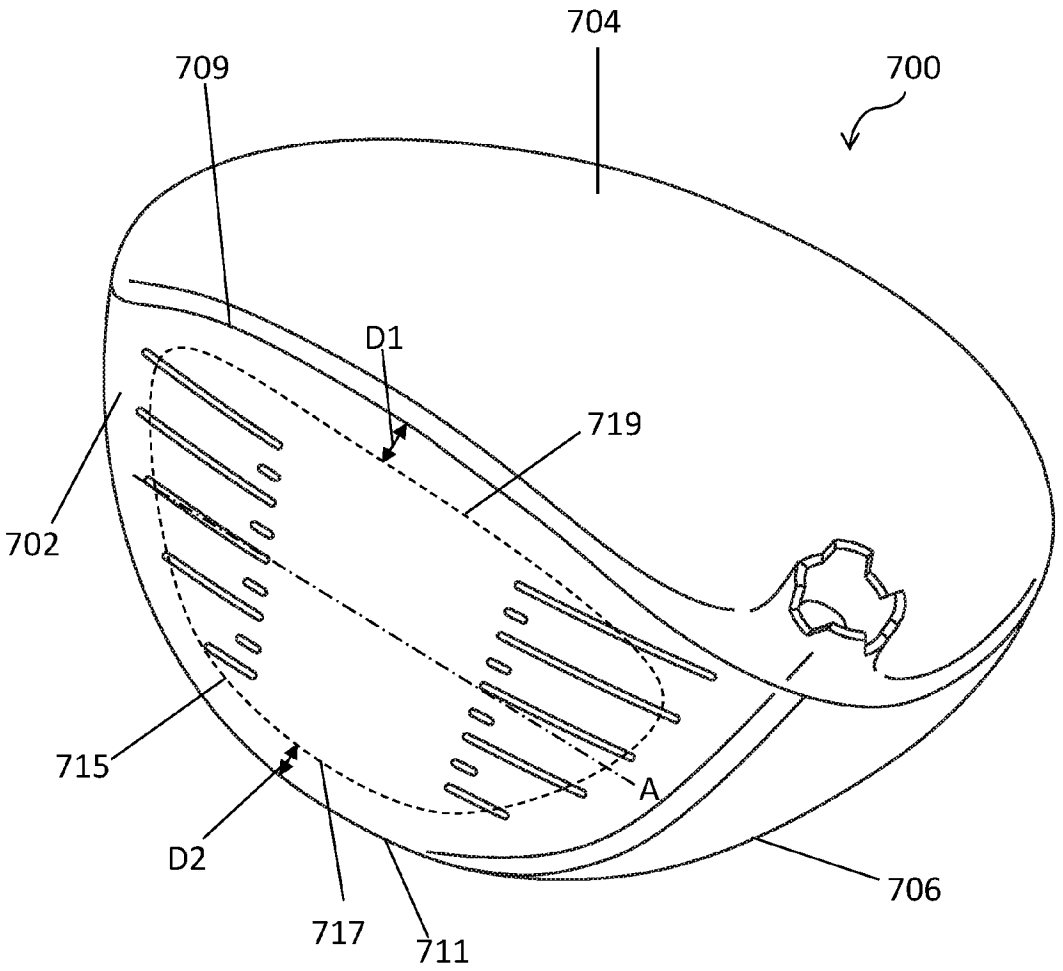
FIG. 7A shows a perspective view of a driver in accordance with the present technology.
Figure 7B:
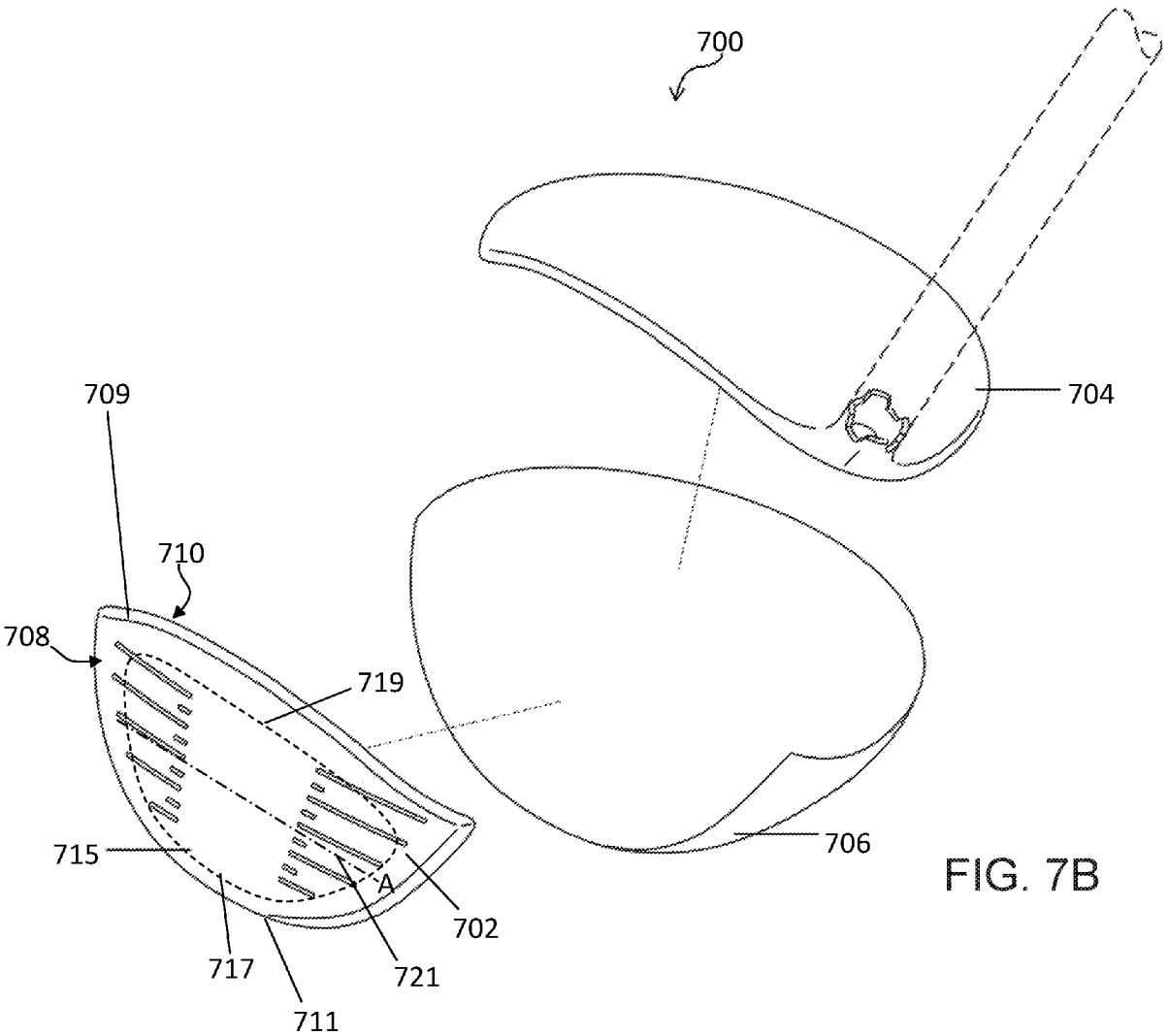
FIG. 7B shows an exploded perspective view of the driver of FIG. 7A in accordance with the present technology.

As discussed above, the forged face 600B may incorporated as a striking face 702 of a driver 700, as shown in FIGS. 7A-7B. The striking face 702 of the driver 700 has a striking surface 708 and rear surface 710. The outer surfaces of the striking face 702 are formed of an outer continuous layer that fully encases an inner layer 715 between the surfaces of the striking face 702. The striking face 702 has a top edge 709 and a bottom edge 711. The inner layer 715 has an upper boundary 719 and a lower boundary 717. The upper boundary 719 is located at a distance D1 from the upper edge of the striking face 702, and the bottom boundary 717 is located at a distance D2 from the bottom edge 711. The central axis A defines an axis running through the center of the inner layer 715. In examples, the distances D1 and D2 are substantially equal and the inner layer 715 is substantially centered in the striking face 702. In examples, the central axis 721 of the inner layer 715 is evenly spaced between the top edge 709 and the bottom edge 711. Other configurations and locations of the inner layer are also contemplated. The striking face 702 is attached to a crown 704 and a sole 706 of the driver 700.

Figure 8:
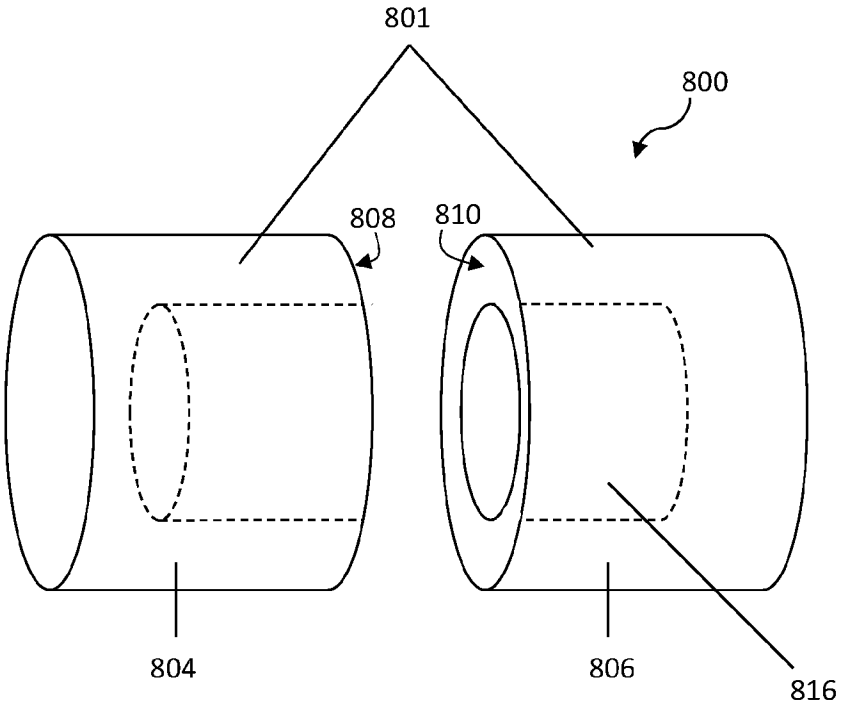
FIG. 8 shows a perspective view of a portion of a pre-formed billet used to create a golf club head in accordance with the present technology.

FIG. 8 shows a perspective view of a pre-formed billet 800 used to create a golf club head in accordance with the present technology. Pre-formed billet 800 has a first portion 804 and a second portion 806, each containing a portion of a cavity 816 defined by a continuous outer layer 801. The pre-formed billet 800 may be used in an alternative process to incorporate an inner layer or weight adjustment portion. The pre-formed billet may be formed by splitting, cutting, or otherwise separating an extrusion of a material, such as a steel rod. A cavity 816 may then be machined or otherwise formed in the first portion 804 and second portion 806 such that the cavity is aligned between the first portion 804 and second portion 806. An inner layer or weight adjustment portion may then be inserted into the cavity 816. The first portion 804 and the second portion 806 are then brought together to encase the inner layer or weight adjustment portion. The inner layer or weight adjustment portion may be sized prior to insertion to ensure a proper fit in the cavity such that a face 808 of the first portion 804 is in contact with a face 810 of the second portion. The first portion 804 and the second portion 806 are then joined via welding, brazing, or other means for joining the two portions together. By utilizing the two-portion pre-formed billet 800, it is no longer necessary to fill the remainder of a cavity after inserting the inner layer or weight adjustment portion as described above with reference to FIGS. 2A-2D.

Figure 9A:
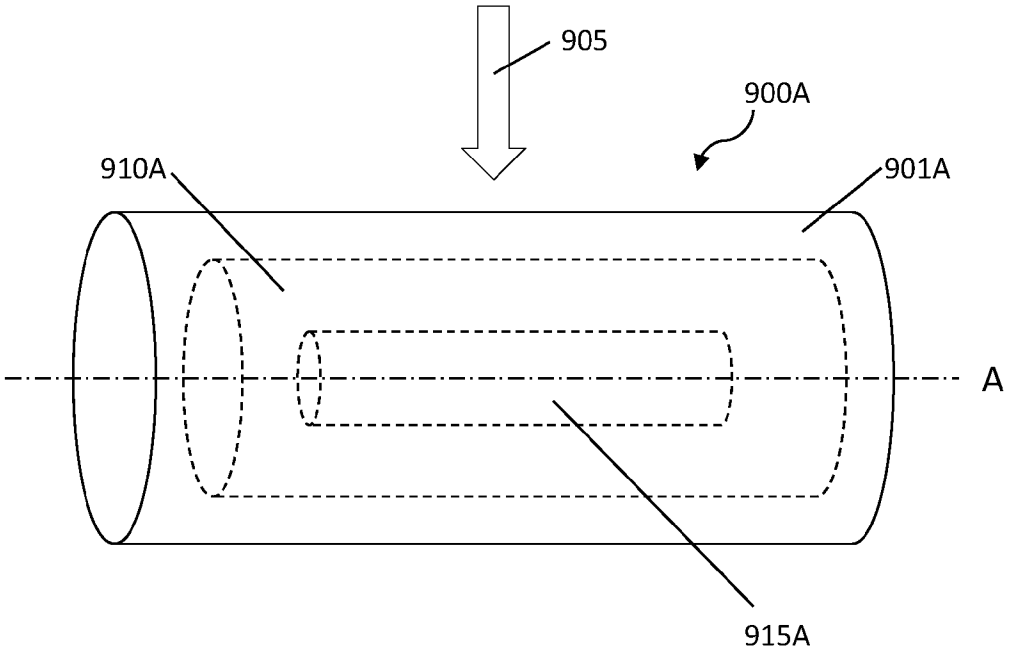
FIG. 9A shows a perspective view a preformed billet used to create a golf club in accordance with the present technology.

FIG. 9 shows a perspective view of a pre-formed billet 900A used to create a golf club head in accordance with the present technology. The pre-formed billet 900A has a continuous outer layer 901A, a continuous middle layer 910A fully encased by the continuous outer layer 901A, and an inner layer 915A fully encased by the continuous middle layer 910A. The inner layer 915A has a central axis A. Pre-formed billet 900A is similar to pre-formed billet 600A except that it has three layers instead of two. By incorporating three layers instead of two layers, the properties of the ultimately forged club head can be further improved or adjusted. In some examples, the continuous outer layer 901A is made of a corrosion resistant material to add further protective properties to the club head. The corrosion resistant material may also be selected so that it is in the same class as the material to which the striking face will be joined, as discussed above. The continuous middle layer 910A may be made of a material having a high Young's Modulus, such as a steel or other similar materials discussed above. The inner layer 915A may be made of material having a lower Young's Modulus, such as a titanium alloy or other similar materials discussed above. In alternative example, the continuous middle layer 910A is made of a material having a low Young's Modulus and the inner layer 915A is made of a material having a higher Young's Modulus. The continuous outer layer 901A may also be thinner than either of the continuous middle layer 910A of the inner layer 915A. In some examples, the continuous outer layer 901A is less than about 10% the thickness of the continuous middle layer 910A. In other examples, the continuous outer layer 901A is less than about 50% the thickness of the continuous middle layer 910A. In examples, each of the inner layer 915A, the continuous middle layer 910A, and the continuous outer layer 901A share a common central axis A. The pre-formed billet 900 may be formed by any of the processes described above for incorporating layers or weight adjustment portions into a billet.

Figure 9B:
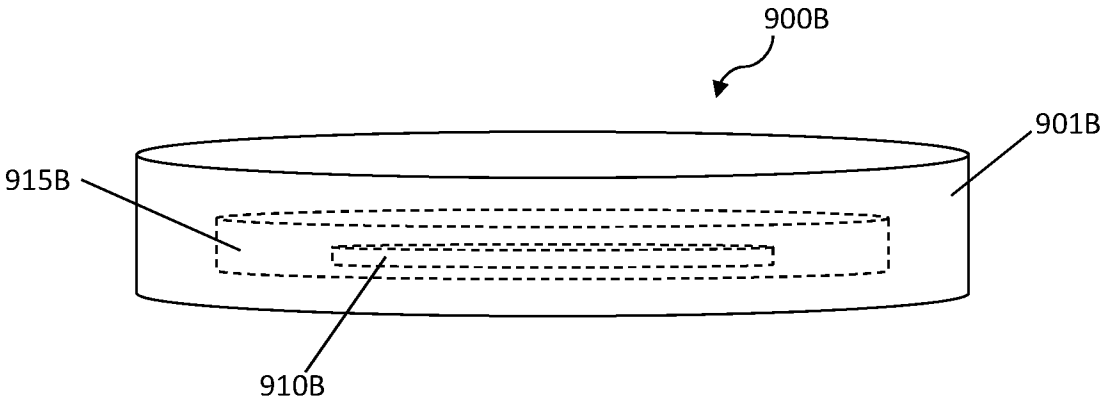
FIG. 9B shows a perspective view of a forged face used to create a golf club head in accordance with the present technology.

In some examples, the pre-formed billet 900A may be forged in forging direction 905, resulting in a forged face 900B having a forged continuous outer later 901B, a forged continuous middle layer 910B, and a forged inner layer 915B, as shown in FIG. 9B. Similar to forged face 600B, the forged face 900B may be formed as any type of striking face to be incorporated into a golf club head, such as striking face 702.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the preceding specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used. Further, the shapes depicted herein may be substituted for additional geometric shapes depending on the requirements or needs of a particular application. For instance, while the pre-formed billets have generally been depicted as cylindrical throughout the present disclosure, the billets may have a different shape, such as an extruded oval, a rectangular prism, a pentagonal prism, a hexagonal prism, or any other multi-sided prism.

The drawings provided herein have not necessarily been drawn to scale and it should be appreciated that different dimensions, sizes, and relative thicknesses of layers may vary depending on particular applications.

It should be understood, of course, that the foregoing relates to exemplary embodiments of the present invention and that modifications may be made without departing from the spirit and scope of the invention as set forth in the following claims.

The invention claimed is:

1. A golf club head comprising:

a sole; and a forged multi-material striking face attached to at least a portion of the sole, the forged multi-material striking face comprising:

a continuous outer layer made of a first material; and an inner layer made of a second material, the inner layer being fully encased by the continuous outer layer, wherein the inner layer is substantially centered within the continuous outer layer and wherein the first material is a titanium-based material that has a lower Young's modulus than a Young's modulus of the second material.

2. The golf club head of claim 1, wherein a top boundary of the inner layer is disposed a first distance from a top edge of the striking face, and wherein a bottom boundary of the inner layer is disposed a second distance from a bottom edge of the striking face, and wherein the first distance and the second distance are substantially the same.

3. The golf club head of claim 1, wherein a central axis of the inner layer is spaced evenly between a top edge and a bottom edge of the striking face.

4. The golf club head of claim 1, wherein the first material has a higher density than the second material.

5. The golf club head of claim 1, further comprising a crown, wherein the crown and the sole are made of the same material as the continuous outer layer of the striking face.

6. The golf club head of claim 5, wherein the crown is joined to a top edge of the striking face and the sole is joined to a bottom edge of the striking face.

7. The golf club head of claim 1, wherein the striking face has a striking surface and a rear surface, and wherein a center point of the inner layer is located a first distance from the striking surface and a second distance from the rear surface, the first distance being less than the second distance.

8. The golf club head of claim 1, wherein the first material has a lower density than the second material.

9. The golf club head of claim 1, wherein the first material has a higher corrosion resistance than a corrosion resistance of the second material.

10. A golf club head comprising:

a forged multi-material striking face, the striking face comprising:

a continuous outer layer made of a first material;

a continuous middle layer made of a second material, the continuous middle layer being fully encased by the continuous outer layer; and an inner layer made of a third material, the inner layer being fully encased by the continuous middle layer, wherein the third material displays a lower Young's modulus than a Young's modulus of the second material.

11. The golf club head of claim 10, wherein the first material displays a corrosion resistance greater than a corrosion resistance of the second material.

12. The golf club head of claim 10, further comprising a crown and a sole, the wherein the crown and the sole are substantially made of the same material as the first material.

13. The golf club head of claim 12, wherein the crown is joined to a top edge of the striking face and the sole is joined to a bottom edge of the striking face.

14. The golf club head of claim 10, wherein the first material is a steel having a first corrosion resistance, the second material is a steel having a second corrosion resistance less than the first corrosion resistance, and the third material is at least one of a titanium and a titanium alloy.

15. The golf club head of claim 10, wherein the continuous outer layer is thinner than the continuous middle layer.

16. The golf club head of claim 15, wherein a thickness of the outer layer is less than ten percent of a thickness of the continuous inner layer.

17. A forged multi-material striking face, comprising:

a continuous outer layer made of a first material; and an inner layer made of a second material, the inner layer being fully encased by the continuous outer layer, wherein the inner layer is substantially centered within the continuous outer layer and wherein the first material is a titanium-based material that has a lower Young's modulus than a Young's modulus of the second material.

18. The forged-multi-material striking face of claim 17, wherein a top boundary of the inner layer is disposed a first distance from a top edge of the striking face, and wherein a bottom boundary of the inner layer is disposed a second distance from a bottom edge of the striking face, and wherein the first distance and the second distance are substantially the same.

19. The forged-multi-material striking face of claim 17, wherein a central axis of the inner layer is spaced evenly between a top edge and a bottom edge of the striking face.

20. The forged-multi-material striking face of claim 17, wherein the first material has a higher corrosion resistance than a corrosion resistance of the second material.

* * * * *